United States Patent [19]

Rickards

[11] 4,018,499

[45] Apr. 19, 1977

[54] CONTACT FOR INSULATED WIRE

[75] Inventor: David William Rickards, Stanmore, England

[73] Assignee: AMP Incorporated, Harrisburg, Pa.

[22] Filed: Jan. 15, 1976

[21] Appl. No.: 649,183

Related U.S. Application Data

[63] Continuation of Ser. No. 525,597, Nov. 20, 1974, abandoned.

[30] Foreign Application Priority Data

Dec. 18, 1973 United Kingdom ..... 58635/73

[52] U.S. Cl. ..... 339/97 C

[51] Int. Cl.[2] ..... H01R 9/08

[58] Field of Search ..... 339/97 R, 97 C, 97 P, 339/98, 99 R

[56] References Cited

UNITED STATES PATENTS

| | | | |
|---|---|---|---|
| 1,706,005 | 3/1929 | Thompson | 339/97 C X |
| 2,302,767 | 11/1942 | Hackbarth | 339/97 C |
| 2,648,050 | 8/1953 | Berg | 339/97 C |
| 3,434,093 | 3/1969 | Wedekind | 339/99 R X |
| 3,539,707 | 11/1970 | Kindell et al. | 339/97 C X |
| 3,878,318 | 4/1975 | Ziegler, Jr. et al. | 339/97 C X |

FOREIGN PATENTS OR APPLICATIONS

| | | | |
|---|---|---|---|
| 641,316 | 5/1962 | Canada | 339/99 R |
| 1,277,977 | 9/1968 | Germany | 339/97 R |

*Primary Examiner*—Roy Lake
*Assistant Examiner*—Howard N. Goldberg
*Attorney, Agent, or Firm*—Allan B. Osborne

[57] ABSTRACT

The contact is stamped from sheet metal and comprises a plate with a wire receiving slot opening into an edge of the plate between two arms and an integral core penetrating lance protruding between the arms into the slot and towards the slot opening, the arms having portions extending laterally towards each other adjacent the opening to define a wire-receiving mouth of restricted size which portions are formed with opposed insulation severing edges facing generally away from the lance.

3 Claims, 3 Drawing Figures

CONTACT FOR INSULATED WIRE

This is a continuation of application Ser. No. 525,597 filed Nov. 20, 1974, and now abandoned.

The invention relates to a contact for insulated wire having a stranded core.

According to the invention, a contact stamped from sheet metal comprises a plate with a wire receiving slot opening into an edge of the plate between two arms and an integral core penetrating lance protruding between the arms into the slot and towards the slot opening, the arms having portions extending laterally towards each other adjacent the opening to define a wire-receiving mouth of restricted size which portions are formed with opposed insulation severing edges facing generally away from the lance.

The contact is such that the severing edges will sever the insulation of the wire when forced transversely of its axis into the slot and the lance will penetrate the core, dividing the strands. The ends of the arms adjacent the opening can then be crimped together to effect a permanent electrical connection between the core and the contact.

Preferably, the plate has an insulation receiving rebate adjacent each side of the root end of the lance. Portions of insulation adjacent the root end of the lance may be extruded into the rebates during crimping.

Desirably, the tips of the arms are pointed to pierce the insulating web of a ribbon cable.

A specific example of a contact according to the invention will now be described with reference to the accompanying drawings in which.

Figure 1:
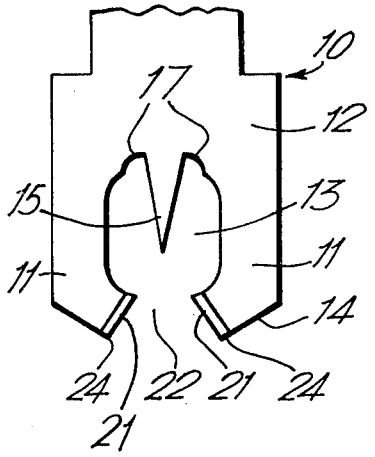
FIG. 1 is a plan view of a portion of the contact.

The contact 10 is stamped from sheet brass and comprises a plate 12 formed with a wire receiving slot 13 which opens into an edge 14 of the plate between two arms 11. An integral lance 15 protrudes into the slot from between the arms towards the opening. Rebates 17 are formed in the plate adjacent each side of the root end of the lance. Portions of the arms adjacent the opening extend laterally toward each other to define a wire receiving mouth 22 of restricted size coined to provide insulation severing edges 21, and having pointed tips 24 to pierce the insulating web of a ribbon cable.

The free ends of the arms have cam surfaces extending forwardly and outwardly in the direction of wire insertion. The arms have opposed parallel edges centrally of the slot and arcuate end portions so that a circular cross-section is obtained at least adjacent the mouth after crimping to a stranded wire.

The end of the contact remote from the plate can be adapted for connection to another wire, for example, by the provision of a tab or socket.

Apparatus for inserting the wire into the slot of the contact and crimping the contact to the wire comprises an insertion plate 30 mounted on guide pins 31 for reciprocal movement relative to a jig 32 on a base 33. The guide pins are located in sleeves 34 which function as stops and are biased away from the base by light springs 36. A lower edge of the insertion plate is formed with a row of wire engaging cut outs 37. A crimping blade 38, formed with crimping dies 39, is aligned with respective cut outs 37 carried by a crimping bar 41 which is mounted on posts 42 for reciprocable sliding movement relative to the base. Return springs 43 bias the crimping blade away from the insertion plate which springs are sufficiently strong to override light springs 36 during downward movement of the crimping blade relative to the base. Thumbscrews 44 are mounted in the bar 41 to determine the crimp height. Drive means (not shown) are connected to drive the crimp bar downwardly via transverse drive bar 45.

In operation of the apparatus, a connector housing 46 preloaded with upstanding contacts is mounted on the jig with the mouth of each contact in alignment with the cut outs 37 and crimping dies. A ribbon cable comprising a series of insulated stranded wires 40 connected by an integral insulating web 35 is then located with wires interposed between the contact mouths and the cut outs 37. The drive means is then operated to drive the crimp bar and blade towards the base. As the return springs 43 are stronger than the springs 36, the crimping blade is driven downwardly to cause the cut outs 37 to insert the wires into the contacts. During insertion the sharp tips of the contacts pierce the web and the severing edges sever the insulation on opposite sides of the wire core. The lance pierces the insulation on the wire and penetrates the core 48 dividing the strands substantially equally on each side of the lance.

Figure 2:
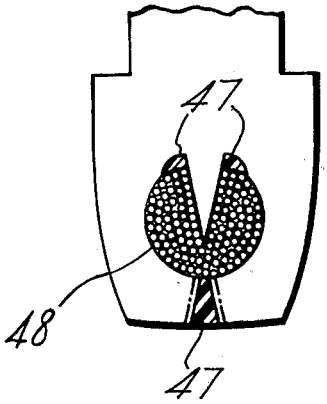
FIG. 2 is a plan view of an electrical connection formed after crimping the contact to an insulated wire having a stranded core.
Figure 3:
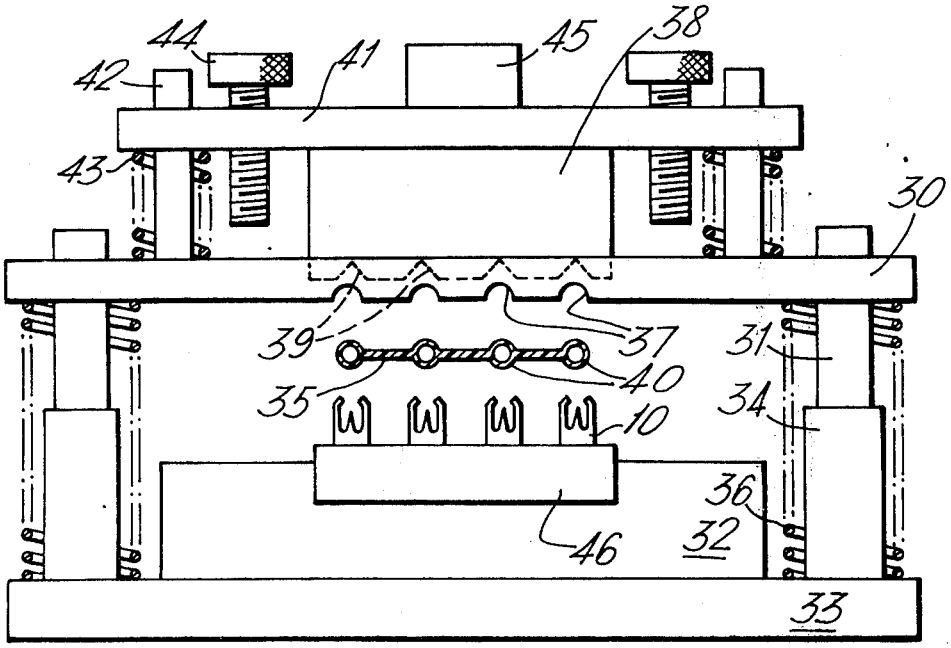
FIG. 3 is an elevational view of crimping apparatus used to effect the connection.

When the wires are fully inserted the movement of the insertion plate is arrested by the sleeves and the crimping blade continues to move relatively towards the jig bringing the crimping dies into engagement with the contact to crimp the free ends of the arms closely together (as shown in FIG. 2).

This causes the portions 47 of insulation to be compressed or extruded into the rebates and between the lips of the contact and the individual strands of the core to be tightly compressed together and confined within the slot.

At the end of the crimping stroke the return springs return the crimp bar and guide plates to their initial position.

Insertion and crimping may be carried out in a single step where wires other than small sizes are used.

The crimped connection provides four areas of electrical contact with the wire core, opposite side edges of the slot and the sides of the lance. The resiliency of the compressed insulation aids the maintenance of the compressive forces on the core while the insulation in the mouth also helps to seal the connection.

Preferably, the initial cross-sectional area of the slot is such, prior to crimping, that the slot area after crimping is equal to the initial core area less the area of the lance.

Where connection is to be made to a wire having a core composed of an odd number of relatively few strands, for example, seven strands, a contact having two such lances preferably spaced apart by a distance slightly greater than the diameters of individual strands may be appropriate to avoid the problem of unequal distribution of the strands on opposite sides of a single lance which would cause significant unequal loading when a relatively small number of strands is used. In this example, an odd number of wires are received between the lances during the insertion.

If a wire has been deformed in manufacture or handling to oval cross-section, there may be a clearance between portions of the insulating sheath adjacent opposite sides of the core and the severing edges during insertion, which may cause incomplete severing of the insulation, leaving a fillet of insulation on opposite sides of the core after insertion which prevents good electrical contact being established between the core and the contact on crimping. In an attempt to ameliorate this disadvantage, insulation severing teeth may protrude into the slot from opposed edges of the slot adjacent the mouth to pierce the fillets of insulation on crimping. As a result of their passage through the mouth, the fillets of insulation may be in a condition of stress after insertion and the teeth may then cause the insulation to split apart on crimping, exposing the core to the opposed edges of the slot.

What is claimed is:

1. A contact for attachment to an insulating stranded conductor without deforming the conductor, comprising:

a. a plate member stamped and formed from a coplanar sheet of conductive material having a conductor-receiving slot opening into one edge of the plate and defining a pair of spaced arms forming the sides of the slot;

b. a lance protruding into the slot from the base thereof and extending toward the slot opening, said lance adapted to enter between the strands of the undeformed conductor which may be inserted into the slot;

c. said arms and lance being located in the plane of the plate whereby the contact is substantially uniplanar;

d. said arms having free ends adapted to be crimped inwardly towards one another whereby a conductor which may be inserted into the slot will be generally encompassed and secured therein.

2. The contact of claim 1 further including insulation receiving rebates on the base of the slot adjacent each side of the lance.

3. The contact of claim 1 further including insulation severing edges on the free ends of the arms, said severing edges facing generally obliquely away from the lance.

* * * * *